US005307091A

United States Patent [19]

DeCoste, Jr.

[11] Patent Number: 5,307,091

[45] Date of Patent: Apr. 26, 1994

[54] JET INK REFILL SUPPLY

[75] Inventor: Charles L. DeCoste, Jr., Richmond, Ky.

[73] Assignee: Lexmark International, Inc., Greenwich, Conn.

[21] Appl. No.: 852,452

[22] Filed: Mar. 16, 1992

[51] Int. Cl.[5] ..... B41J 2/175

[52] U.S. Cl. ..... 346/140 R

[58] Field of Search ..... 346/140 R, 75; 222/95, 222/105

[56] References Cited

U.S. PATENT DOCUMENTS

| | | | |
|---|---|---|---|
| 4,183,031 | 1/1980 | Kyser et al. | 346/140 R |
| 4,695,824 | 9/1987 | Tazaki | 346/140 R |
| 4,760,409 | 7/1988 | Kiyohara et al. | 346/140 R |
| 4,814,794 | 3/1989 | Sato | 346/140 R |
| 4,928,126 | 5/1990 | Asai | 346/140 R |
| 5,023,629 | 6/1991 | Kiyohara | 346/140 R |
| 5,138,344 | 8/1992 | Ujita | 346/140 R |

FOREIGN PATENT DOCUMENTS

| | | | |
|---|---|---|---|
| 0364284 | 4/1990 | European Pat. Off. | B41J 2/175 |
| 59-277458 | 12/1984 | Japan | B41J 2/175 |
| 0125671 | 7/1985 | Japan | 346/75 |
| 01033749 | 5/1989 | Japan | B41J 3/04 |
| 0111258 | 5/1991 | Japan | 222/95 |

*Primary Examiner*—Benjamin R. Fuller
*Assistant Examiner*—Alrick Bobb
*Attorney, Agent, or Firm*—John A. Brady

[57] ABSTRACT

Ink jet replacement cartridge (1) has a hinged cover (5, 3) and receives replacement bag (21) having an internal ink-containing bag (15) and internal absorbent paper (23) in external bag (25), which has an opening (27) to receive excess ink from printer. Only the external bag and its contents is replaced. The absorbent paper holds ink so the used bag is clean to handle.

5 Claims, 1 Drawing Sheet

JET INK REFILL SUPPLY

TECHNICAL FIELD

This invention relates to liquid ink refill supplies for ink jet printers. An existing supply is a hard casing housing a bag containing ink and an absorbent pad for excess ink returned by the printer. The casing is discarded with each refill. This invention avoids the replacement of the hard casing.

BACKGROUND OF THE INVENTION

A refill supply of the kind this invention modifies is shown in U.S. Pat. No. 4,760,409. That is a three dimensional structure generally having the outline of a brick or building block. That supply is mounted in the printer where a needle pierces a rubber stopper to connect ink in a bag in the supply through a tube to the printer. A second tube in the printer is connected back to the supply.

More specifically, this invention is a modification of the prior art supply sold by various firms including the assignee of this invention, which sells the supply as the IBM Ink Cartridge for the IBM 4072 Printer. That supply has ink in a bag resting on absorbent paper or felt, with an opening in the casing for a tube from the printer which returns excess ink. The casing is sealed, and the entire casing is discarded with each refill. The absorbent paper absorbs the return ink so that it is held in the casing.

In accordance with this invention the casing is hinged and the ink bag and absorbent paper are encased in an outer bag. Only the outer bag and its contents are discarded.

U.S. Pat. Nos. 5,023,629 to Kiyohara and 4,695,824 to Tazaki show variations of the foregoing type of supply. U.S. Pat. Nos. 4,928,126 to Asai and 4,183,031 to Kyser et al show ink supplies in a bag with the bag in a container. None of these patents are closely relevant to this invention since they do not teach an outer bag surrounding the ink bag and an absorbent material.

DISCLOSURE OF THE INVENTION

In accordance with this invention the outer casing of the ink-refill supply is not sealed. Inside the casing is the ink bag and the absorbent material, both within an outer bag.

In use the casing is opened, the outer bag and its contents are removed and a fresh outer bag with contents are replaced. The more bulky case is used repeatedly. This reduces total waste to be disposed of. Additionally, the refill bag is less bulky during shipment and storage than the previous hard casing. Since the absorbent paper traps all returned ink, the refill bag does not leak ink and is clean to handle.

BRIEF DESCRIPTION OF THE DRAWING

The details of this invention will be described in connection with the accompanying drawing, in which.

BEST MODE FOR CARRYING OUT THE INVENTION

Figure 1:
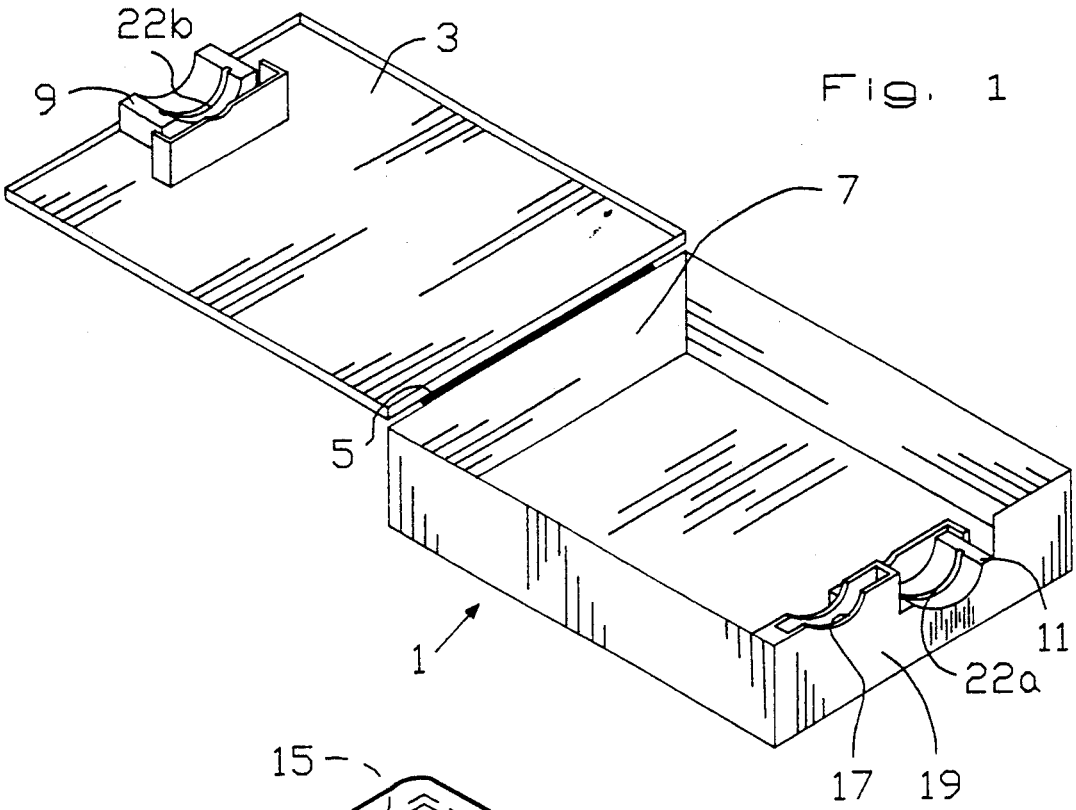
FIG. 1 shows the empty cartridge of this invention.

FIG. 1 shows the open, empty cartridge 1 of this invention, which is identical to the sealed cartridge of the foregoing prior art ink cartridge for the 4072 printer except the cover 3 is hinged so that it can be opened as shown, an ink baffle adjacent bracket 9 is eliminated, and absorbent paper in and near hole 11 is eliminated. Hinge 5 may be simply a thin connection between the cover 3 and the back panel 7 of cartridge 1.

Figure 2:
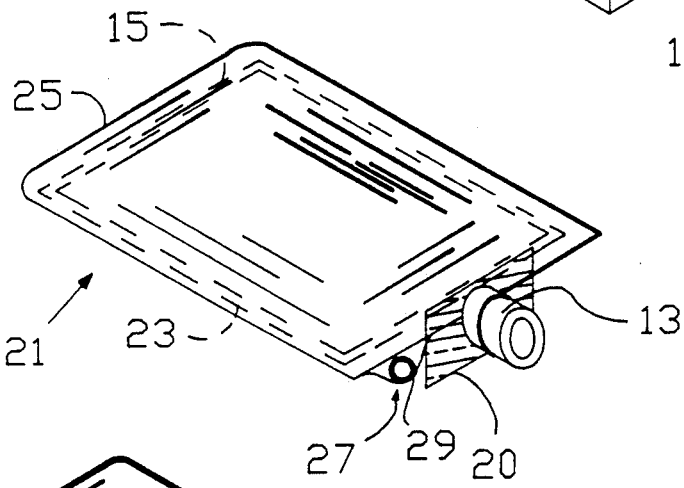
FIG. 2 shows the replacement bag of this invention.
Figure 3:
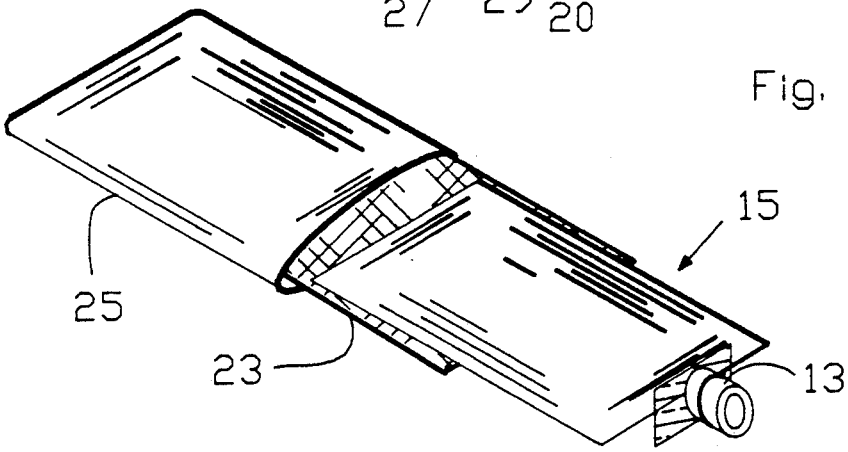
FIG. 3 shows the replacement bag with its three major elements separated but in the vertical relationship as when they are together.

Cartridge 1 has upper bracket 9 and lower bracket 11 which fit closely around the metal plug 13 (FIG. 2) of the ink bag 15 having refill ink when cover 3 is closed. (Lamination 20, which is stiff, fits in slots **22*a* and 22*b* of brackets 9 and 11.) Cartridge 1 has an opening or hole 17 in front panel 19 in which a tube from the printer (not shown) passes during use to deliver excess ink. Plug 13 contains material pierced by another tube from the printer (not shown) to supply ink from bag 15** for use by the printer.

The refill bag 21 contains ink bag 15 and a layer of absorbent paper 23 which is on the bottom side of cartridge 1 when installed and is generally coextensive with the,. bag 15. A second, outer bag 25 fits closely around bag 15. Bag 25 is of compliant thermoplastic, such as high density polyethylene, and is heat sealed to the edge of refill bag 15 at the side having plug 13. Outer bag 25 is entirely closed except for a opening 27 located to communicate with opening 17 of cartridge 1. Opening 27 is formed by bag 25 being sealed to thin, rigid ring 29, which may be of stiff plastic material. (Alternatively, bag 25 may simply have an opening 27 which is not supported and so which tends to close, but front panel 19 of cartridge 1 would have spaced pins on opposite sides of opening 17 which would open 27 and hold it open.)

In use plug 13 of a bag 21 having a full ink bag 15 is placed in the lower bracket 11 with the body of bags 15 and 25 positioned in the cartridge 1. Cover 3 is closed and latched (as by a simple, yieldable clip on cover 3, not shown). Openings 17 and 27 are located to be aligned when bag 21 is positioned in cartridge 1 since bag 21 is the same lateral size as the body of cartridge 1.

When the ink in bag 15 is depleted, the operator removes cartridge 1 from the printer (not shown), opens cover 3, extracts bag 21, thereby emptying cartridge 1. A new bag 21 is loaded by placing plug 13 of the fresh bag 15 in the brackets 9 and 11 as described.

Accordingly, only bag 21 and its contents are waste to be discarded. In shipping and handling new supplies, only bag 21 and its contents are involved. Absorbent paper 23 holds the returned ink so the used bag 21 is clean during normal handling.

Alternatives will be apparent and may be devised which are within the spirit and scope of this invention. In particular, the outer bag 25 might be positioned by adhesive.

I claim:

1. A refill ink supply for a printer comprising an inner bag to hold ink and to be connected to said printer, an absorbent material external to said inner bag, and an outer bag positioned around said inner bag and said absorbent material, said outer bag having an opening to receive ink from said printer and being of compliant material, said opening being formed by said outer bag being sealed around a thin, rigid closed member, said inner bag having an edge at which a plug is located.

2. A refill ink supply for a printer comprising an inner bag to hold ink and to be connected to said printer, an absorbent material external to said inner bag, and an outer bag positioned around said inner bag and said absorbent material, said outer bag having an opening to receive ink from said printer and being of compliant material, said outer bag being a thin thermoplastic material sealed around a thin, rigid closed member to form said opening, said inner bag having an edge at which a plug is located and said outer bag being sealed to said edge of said inner bag.

3. An ink supply having refillable contents comprising a rigid housing having a first panel with a braket, said first panel may be opened and closed to provide access to an interior of said housing, said housing further including a front panel having a bracket and a hole, a bag to hold ink having a rigid plug formed to be held by the bracket of said first and said front panel to provide a connection for ink in said bag, an absorbent material external to said inner bag, and an outer bag positioned around and containing said inner bag and said absorbent material, said outer bag having an opening positioned in communication with said hole when said plug is held by said bracket and said outer bag is in said housing, said opening being formed by said outer bag being sealed around a thin, rigid closed member, said outer bag and said contents of said outer bag being removable and replaceable by opening said first panel.

4. The ink supply as in claim 3 in which said inner bag to hold ink has an edge at which said plug is located and said outer bag is sealed to said edge of said inner bag to hold ink.

5. An ink supply for a printer comprising (a) an inner bag to hold ink having a plug through which ink in the inner bag can be supplied to said printer, (b) an absorbent material external to said inner bag, (c) an outer bag, containing the absorbent material and the inner bag, having an opening through which ink from the printer can be received and communicated to said absorbent material, said opening being formed by said outer bag being sealed around a thin, rigid closed member, and (d) a cartridge, more rigid than the outer bag, comprising a first and second panel in which can be opened and closed and into which to provide access to an interior of said cartridge the outer bag can be placed, said cartridge having at least one opening when the first panel is closed to permit ink to be supplied through the plug to the outside of the cartridge and at least one hole in said second panel to permit ink to be supplied through the opening in the outer bag from the outside of the cartridge.

* * * * *